US007937953B2

(12) United States Patent
Tsai

(10) Patent No.: US 7,937,953 B2
(45) Date of Patent: May 10, 2011

(54) THERMOELECTRIC HEAT PUMP FOR HEAT AND ENERGY RECOVERY VENTILATION

(75) Inventor: Chung-Yi Tsai, Arden Hills, MN (US)

(73) Assignee: Carrier Corporation, Farmington, CT (US)

( * ) Notice: Subject to any disclaimer, the term of this patent is extended or adjusted under 35 U.S.C. 154(b) by 523 days.

(21) Appl. No.: 11/990,592

(22) PCT Filed: Aug. 15, 2005

(86) PCT No.: PCT/US2005/028885

§ 371 (c)(1),
(2), (4) Date: Feb. 15, 2008

(87) PCT Pub. No.: WO2007/021272

PCT Pub. Date: Feb. 22, 2007

(65) Prior Publication Data

US 2009/0126370 A1 May 21, 2009

(51) Int. Cl.
*F25B 21/02* (2006.01)

(52) U.S. Cl. ..... 62/3.3; 62/3.6

(58) Field of Classification Search ..... 62/3.2, 62/3.3, 3.7
See application file for complete search history.

(56) References Cited

U.S. PATENT DOCUMENTS 3,077,680 A * 2/1963 Moustakidis et al. ..... 36/36 R
5,226,298 A 7/1993 Yamamoto et al.
5,761,908 A * 6/1998 Oas et al. ..... 62/3.2

FOREIGN PATENT DOCUMENTS

EP 1048339 A1 11/2000
WO WO0169154 A1 9/2001

OTHER PUBLICATIONS

Official Search Report of the Patent Cooperation Treaty in counterpart foeign Application No. PCT/US05/28885 filed Aug. 15, 2005.
Extended European Search Report and Supplementary European Sear Report, PCT/US2005028885, Jul. 1, 2010, 5 pp.

* cited by examiner

*Primary Examiner* — Melvin Jones
(74) *Attorney, Agent, or Firm* — Cantor Colburn LLP

(57) ABSTRACT

A thermoelectric heat pump (10) is provided including a thermoelectric array (30) having alternating P-type and N-type semiconductors (33, 34) and one or more water transport membranes (20).

10 Claims, 1 Drawing Sheet

THERMOELECTRIC HEAT PUMP FOR HEAT AND ENERGY RECOVERY VENTILATION

BACKGROUND OF THE INVENTION

1. Field of the Invention

This invention relates generally to ventilation systems and, more particularly, to a method and apparatus for a thermoelectric heat pump for heat and energy recovery ventilation.

2. Description of the Related Art

Ventilation systems generally recirculate air for heating and cooling applications. In particular, heat recovery ventilation and energy recovery ventilation are capable of transferring heat and/or moisture. Heat recovery ventilation and energy recovery ventilation provide benefits such as increasing a ventilation system's overall operating efficiency and lower operating costs. Heat pumps in heat recovery ventilation and energy recovery ventilation can further increase such benefits through enhanced heat transfer. Moreover, heat pumps having greater width to thickness ratios reduce the cost of manufacturing and further improve the efficiency of known energy recovery ventilation and heat recovery ventilation devices.

Accordingly, there is a need for enhanced heat transfer in energy recovery ventilation and heat recovery ventilation.

It is an object of the present invention to provide a thermoelectric heat pump for heat recovery ventilation and energy recovery ventilation.

It is another object of the present invention to provide a thermoelectric heat pump for heat recovery ventilation and energy recovery ventilation having a greater width to thickness ratio.

SUMMARY OF THE INVENTION

In one aspect, a thermoelectric heat pump is provided. The thermoelectric heat pump comprises a thermoelectric array and one or more water vapor transport membranes. The thermoelectric array has a cold side in thermal communication with a first air stream and a warm side in thermal communication with a second air stream. The one or more water vapor transport membranes are connected to the thermoelectric array and in fluid communication with the first and second air streams.

In another aspect, a method of pumping heat in a heat recovery ventilation system or an energy recovery ventilation system is provided which comprises thermoelectrically pumping heat from a first air stream to a second air stream by a thermoelectric array and transferring moisture from the first air stream to the second air stream through a plurality of water vapor transfer membranes integrated with the thermoelectric array and in fluid communication with the first and second air streams.

The thermoelectric array can have a width to thickness ratio of greater than or equal to 100. The thermoelectric array may have a plurality of P-type semiconductors alternating with a plurality of N-type semiconductors. Each of the plurality of P-type semiconductors can be connected to one of a plurality of first metal elements and one of a plurality of second metal elements opposite to the one of the first metal elements. Each of the plurality of N-type semiconductors can be connected to one of the plurality of first metal elements and one of the plurality of second metal elements opposite to the one of the plurality of first metal elements. The plurality of P-type semiconductors and the plurality of N-type semiconductors can be connected by being positioned between one of the plurality of first metal elements and one of the plurality of second metal elements.

The one or more water vapor transfer membranes can be a plurality of water vapor transfer membranes. One of the plurality of water vapor transfer membranes can be integrated with each of the plurality of first metal elements. One of the plurality of water vapor transfer membranes may be integrated with each of the plurality of second metal elements. Each of the plurality of water vapor transport membranes can be positioned between one of the plurality of P-type semiconductors and one of the plurality of N-type semiconductors.

The first air stream can be a hot and humid air stream and the second air stream can be a cold and dry air stream. The thermoelectric array can pump heat from the hot and humid air stream to the cold and dry air stream. The first air stream can be a cold and dry air stream and the second air stream can be a hot and humid air stream. The thermoelectric array can pump heat from the cold and dry air stream to the hot and humid air stream. The warm side and side cold side can each be connected to a heat exchanger selected from a group consisting of a plate heat exchanger, a fin heat exchanger, microchannels, foam, or any combinations thereof. The first air stream may be hot and humid and the second air stream may be cold and dry. The first air stream may be cold and dry and the second air stream may be hot and humid. The thermoelectric array can have a cold side and a warm side.

The above-described and other features and advantages of the present disclosure will be appreciated and understood by those skilled in the art from the following detailed description, drawings, and appended claims.

DETAILED DESCRIPTION OF THE INVENTION

Figure 1:
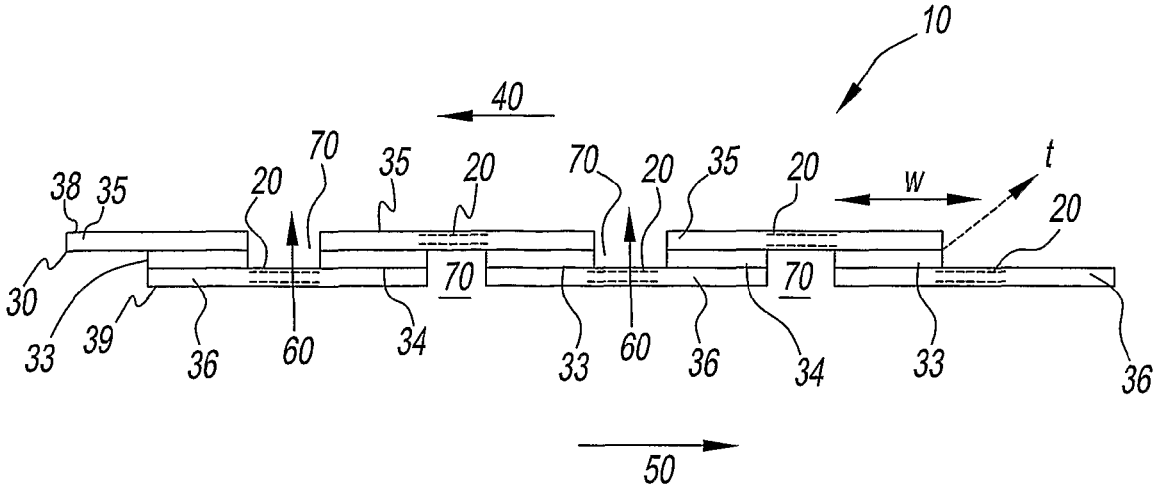
FIG. 1 is a schematic side view of a thermoelectric heat pump of the present invention.

Referring now to FIG. 1, an exemplary embodiment of a thermoelectric heat pump generally referred to by reference numeral 10 is illustrated. Heat pump 10 may pump heat from hot and humid air streams to cold and dry air streams in heat recovery ventilation systems or energy recovery ventilation systems. Furthermore, the operation of heat pump 10 may be reversed in heat recovery ventilation systems or energy recovery ventilation systems to pump heat from cold and dry air streams to hot and humid air streams for applications, such as, for example, use of an air conditioner in the summer months.

Figure 2:
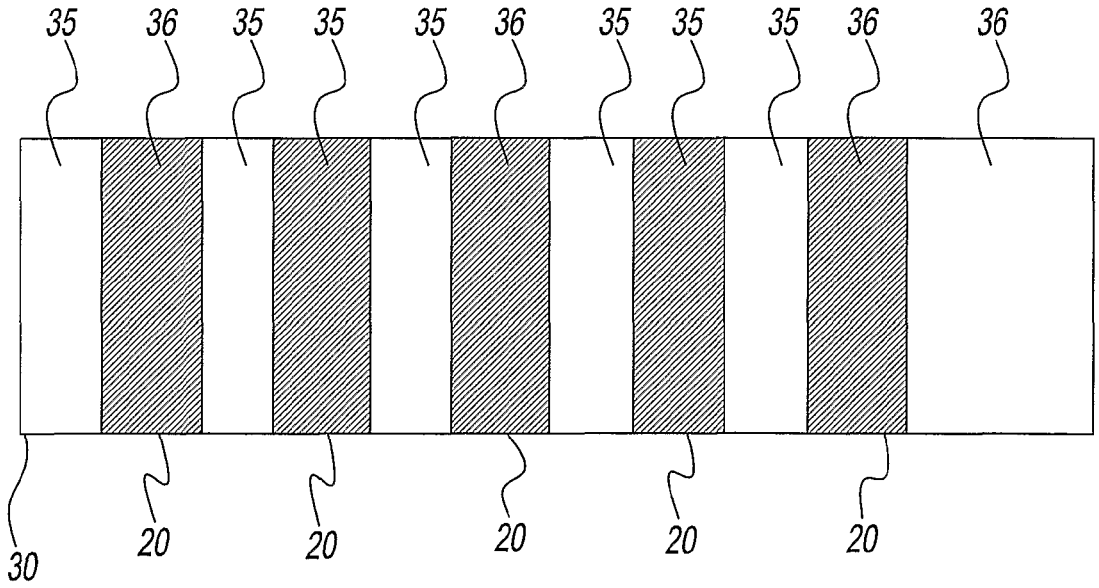
FIG. 2 is a schematic top view of the thermoelectric heat pump of FIG. 1.

In an exemplary embodiment, heat pump 10 has a thermoelectric array 30. Thermoelectric array 30 has alternating P-type semiconductors 33 with N-type semiconductors 34. Each of the P-type semiconductors 33 is connected to one of the first metal elements 35 and one of the second metal elements 36 opposite to the first metal elements 35. Each of the N-type semiconductors 34 is connected to one of the first metal elements 35 and one of the second metal elements 36 opposite to the first metal elements 35. P-type semiconductors 33 are connected with N-type semiconductors by alternating first metal elements 35 and second metal elements 36 forming a cold side 39 in communication with a hot and humid air stream represented by arrow 50 and a warm side 38 in communication with a cold and dry air stream represented by arrow 40. It should be understood that first and second metal elements 35 and 36 can be made from any electrically conductive, and preferably thermally conductive, material but are herein described as metal elements. Water vapor transport membranes 20 can be incorporated into thermoelectric array 30. Water vapor transport membranes 20 may be integrated with first metal elements 35 and second metal elements 36, preferably, so that water vapor transport membranes 20 are positioned between P-type semiconductors and N-type semiconductors in first and second metal elements 35 and 36, as seen in FIGS. 1 and 2.

In the exemplary embodiment, thermoelectric array 30 thermoelectrically conducts or pumps heat from hot and humid air stream 50 in communication with cold side 39 to cold and dry air stream 40 in communication with warm side 38. Furthermore, water vapor transport membranes 20 may transfer moisture from hot and humid air stream 50 to cold and dry air stream 40 as represented by arrows 60. Moreover, thermoelectric array 30 may thermoelectrically conduct or pump heat from cold and dry air streams in communication with cold side 39 to hot and humid air streams in communication with warm side 38. Water vapor transport membranes 20 may also transfer moisture from cold and dry air streams to hot and humid air streams. In the exemplary embodiment, spaces 70 are provided between the alternating P-type semiconductors 33 and N-type semiconductors 34. The spaces 70 are positioned above or below each of the water vapor transport membranes 20 thereby facilitating the flow of moisture into the air stream 40. The particular positioning of the P-type semiconductors 33 and N-type semiconductors 34 with respect to the first and second metal elements 35 and 36 can be varied to facilitate the flow of heat between air streams 40 and 50. In the exemplary embodiment, the P-type semiconductors 33 and N-type semiconductors 34 are positioned along opposing end portions of the first and second metal elements 35 and 36 with the spaces 70 positioned in a middle portion of the metal elements.

The particular type, including materials, dimensions and shape, of P-type semiconductors 33, N-type semiconductors 34, first metal elements 35, and second metal elements 36 of thermoelectric array 30 that are utilized can vary according to the particular needs of heat pump 10. The warm side 38 and cold side 39 may be modified to increase a contact surface directly or indirectly with cold and dry air stream 40 and hot and humid air stream 50. The width w to thickness t ratio of heat pump 10 can be larger than 100. Thus, the cost of manufacturing can be reduced and may improve the efficiency of known energy recovery ventilation and heat recovery ventilation devices.

The particular type, including materials, dimensions and shape, of each of water vapor transport membranes 20 that are utilized can vary according to the particular needs of heat pump 10.

In addition, plate and/or fin heat exchangers or other type of heat exchangers, e.g., micro-channels or foam, can be attached to surfaces of warm and cold sides 38 and 39 to improve heat transfer. Also, alternative configurations of the P-type semiconductors 33 and N-type semiconductors 34 can also be used. The particular structure and/or method used to deliver energy and to thermoelectric array 30 can also be varied by one of ordinary skill in the art to facilitate the transfer of heat, and can include various electrical components including power sources.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

What is claimed is:

1. A thermoelectric heat pump comprising:

a thermoelectric array having a cold side in thermal communication with a first air stream and a warm side in thermal communication with a second air stream; and a plurality of water vapor transport membranes connected to said thermoelectric array and in fluid communication with said first and second air streams;

wherein said thermoelectric array has a plurality of P-type semiconductors alternating with a plurality of N-type semiconductors, wherein each of said plurality of P-type semiconductors is connected to one of a plurality of first metal elements and one of a plurality of second metal elements opposite to said one of said first metal elements, wherein each of said plurality of N-type semiconductors is connected to one of said plurality of first metal elements and one of said plurality of second metal elements opposite to said one of said plurality of first metal elements, and wherein said plurality of P-type semiconductors and said plurality of N-type semiconductors are connected by being positioned between one of said plurality of first metal elements and one of said plurality of second metal elements;

wherein each of said plurality of water vapor transfer membranes is integrated with one of said plurality of first metal elements or said plurality of second metal elements.

2. A thermoelectric heat pump comprising:

a thermoelectric array having a cold side in thermal communication with a first air stream and a warm side in thermal communication with a second air stream; and one or more water vapor transport membranes connected to said thermoelectric array and in fluid communication with said first and second air streams;

wherein said thermoelectric array has a width (w) to thickness (t) ratio of greater than or equal to 100.

3. The thermoelectric heat pump of claim 1, wherein said first air stream is a hot and humid air stream and said second air stream is a cold and dry air stream (40), and wherein said thermoelectric array pumps heat from said hot and humid air stream to said cold and dry air stream.

4. The thermoelectric heat pump of claim 1, wherein said first air stream is a cold and dry air stream and said second air stream is a hot and humid air stream, and wherein said thermoelectric array pumps heat from said cold and dry air stream to said hot and humid air stream.

5. The thermoelectric heat pump of claim 1, wherein said warm side and side cold side are each connected to a heat exchanger selected from a group consisting of a plate heat exchanger, a fin heat exchanger, micro-channels, foam, or any combinations thereof.

6. A method of pumping heat in a heat recovery ventilation system or an energy recovery ventilation system, the method comprising:

thermoelectrically pumping heat from a first air stream to a second air stream by a thermoelectric array; and transferring moisture from said first air stream to said second air stream through a plurality of water vapor transfer membranes integrated with said thermoelectric array and in fluid communication with said first and second air streams;

wherein said thermoelectric array has a plurality of P-type semiconductors alternating with a plurality of N-type semiconductors, wherein each of said plurality of P-type semiconductors is connected to one of a plurality of first metal elements and one of a plurality of second metal elements opposite to said one of said first metal elements, wherein each of said plurality of N-type semiconductors is connected to one of said plurality of first metal elements and one of said plurality of second metal elements opposite to said one of said plurality of first metal elements, and wherein said plurality of P-type semiconductors and said plurality of N-type semiconductors are connected by being positioned between one of said plurality of first metal elements and one of said plurality of second metal elements;

wherein each of said plurality of water vapor transfer membranes is integrated with one of said plurality of first metal elements or said plurality of second metal elements.

7. The method of claim 6, wherein said first air stream is hot and humid and said second air stream is cold and dry.

8. The method of claim 6, wherein said first air stream is cold and dry and said second air stream is hot and humid.

9. The method of claim 6, wherein said thermoelectric array has a cold side and a warm side.

10. The method of claim 9, wherein said warm side and side cold side are each connected to a heat exchanger selected from a group consisting of a plate heat exchanger, a fin heat exchanger, micro-channels, foam, or any combination thereof.

* * * * *